US010215170B2

(12) United States Patent
Rill

(10) Patent No.: US 10,215,170 B2
(45) Date of Patent: Feb. 26, 2019

(54) PUMP-REGULATOR COMBINATION WITH POWER LIMITATION

(71) Applicant: Robert Bosch GmbH, Stuttgart (DE)

(72) Inventor: Egon Rill, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 182 days.

(21) Appl. No.: 15/282,180

(22) Filed: Sep. 30, 2016

(65) Prior Publication Data

US 2017/0089332 A1 Mar. 30, 2017

(30) Foreign Application Priority Data

Sep. 30, 2015 (DE) ..... 10 2015 218 832

(51) Int. Cl.

| | |
|---|---|
| ***F04B 49/22*** | (2006.01) |
| ***F04B 1/14*** | (2006.01) |
| ***F04B 1/29*** | (2006.01) |
| ***F04B 17/05*** | (2006.01) |
| ***F04B 19/22*** | (2006.01) |
| ***F04B 23/10*** | (2006.01) |
| ***F04B 49/12*** | (2006.01) |

(Continued)

(52) U.S. Cl.

CPC ..... *F04B 49/22* (2013.01); *F04B 1/146* (2013.01); *F04B 1/2078* (2013.01); *F04B 1/295* (2013.01); *F04B 1/324* (2013.01); *F04B 17/05* (2013.01); *F04B 19/22* (2013.01); *F04B 23/106* (2013.01); *F04B 49/125* (2013.01); *F04B 53/14* (2013.01); *F04B 53/16* (2013.01); *F04C 2/084* (2013.01); *F04C 2/18* (2013.01); *F04C 11/006* (2013.01); *F15B 9/16* (2013.01); *F15B 11/165* (2013.01); *F15B 2211/20553* (2013.01)

(58) Field of Classification Search

CPC .... F04B 49/022; F04B 49/035; F04B 49/225; F15B 11/165

See application file for complete search history.

(56) References Cited

U.S. PATENT DOCUMENTS

| | | | | |
|---|---|---|---|---|
| 5,701,933 | A * | 12/1997 | Lunzman | E02F 9/2228 137/596.12 |
| 2015/0136251 | A1* | 5/2015 | Knapper | F15B 11/163 137/565.11 |
| 2017/0254308 | A1* | 9/2017 | Mast | F02N 7/08 |

FOREIGN PATENT DOCUMENTS

| | | | | |
|---|---|---|---|---|
| DE | 4391634 | B4 * | 7/2004 | E02F 9/2225 |
| DE | 102010048070 | A1 * | 10/2011 | F04B 49/002 |

(Continued)

*Primary Examiner* — F. Daniel Lopez
*Assistant Examiner* — Matthew Wiblin
(74) *Attorney, Agent, or Firm* — Maginot, Moore & Beck LLP

(57) ABSTRACT

A pump-regulator combination includes first and second pumps, a control valve, first orifice, and pilot valve. The first pump is configured to pump fluid from a tank to a first point. The control valve is configured to control pressure and/or delivery flow at the first point by adjusting a displacement volume of the first pump. The second pump is configured to pump fluid from the tank to a second point, through the first orifice, and back to the tank. A highest load pressure of the actuator is connected to a third point. The pilot valve includes an adjustable second orifice connected to the third point, via a fourth point, and the tank to pass fluid from the actuator to the tank. A pressure at the second point acts to close the second orifice. A pressure of the fourth point acts to adjust the control valve.

9 Claims, 2 Drawing Sheets

(51) Int. Cl.

| | |
|---|---|
| ***F04B 53/14*** | (2006.01) |
| ***F04B 53/16*** | (2006.01) |
| ***F04C 2/08*** | (2006.01) |
| ***F04C 11/00*** | (2006.01) |
| ***F15B 9/16*** | (2006.01) |
| ***F04B 1/20*** | (2006.01) |
| ***F04B 1/32*** | (2006.01) |
| ***F04C 2/18*** | (2006.01) |
| ***F15B 11/16*** | (2006.01) |

(56) References Cited

FOREIGN PATENT DOCUMENTS

| | | | | | |
|---|---|---|---|---|---|
| DE | 102016205574 | A1 | * | 10/2017 | ..... F15B 11/163 |
| EP | 2 431 538 | A1 | | 3/2012 | |
| JP | 2008-291731 | A | | 12/2008 | |
| WO | WO 9505544 | A1 | * | 2/1995 | ..... E02F 9/2232 |
| WO | WO 0073664 | A1 | * | 12/2000 | ..... E02F 9/2232 |
| WO | WO 2007121873 | A1 | * | 11/2007 | ..... E02F 9/2203 |
| WO | WO 2010074507 | A2 | * | 7/2010 | ..... E02F 9/2235 |
| WO | 2014/156532 | A1 | | 10/2014 | |

* cited by examiner

PUMP-REGULATOR COMBINATION WITH POWER LIMITATION

This application claims priority under 35 U.S.C. § 119 to patent application no. DE 10 2015 218 832.9, filed on Sep. 30, 2015 in Germany, the disclosure of which is incorporated herein by reference in its entirety.

The disclosure relates to a pump-regulator combination and to a hydraulic drive system having a pump-regulator combination of this kind.

BACKGROUND

WO 2014/156 532 A1 discloses a pump-regulator combination. The pump-regulator combination has a first pump with an adjustable displacement volume and a second pump with a constant displacement volume, which are driven jointly by a motor. A control valve, by means of which the pressure and/or the delivery flow at a work connection point can be controlled by adjusting the displacement volume of the first pump, is furthermore provided. A first orifice is furthermore provided, wherein pressure fluid can be pumped from the tank via the second pump and onward via the first control point.

SUMMARY

One advantage of the pump-regulator combination proposed is that the maximum driving power to be produced by the motor is limited in a simple manner.

The proposal is that a pilot valve having an adjustable second orifice is provided, wherein pressure fluid can be passed from the load pressure connection point, via a second control point, onward via the second orifice, into the tank, wherein the pressure at the first control point acts on the pilot valve in the closing direction of the second orifice, wherein the pressure at the second control point acts on the control valve in the sense of an adjustment.

The first pump is preferably an axial piston pump, which is most preferably of swashplate-type design. The second pump is preferably a gear pump, most preferably an external gear pump. The first and the second pump are preferably driven jointly by a motor, in particular an internal combustion engine. The first and the second pump preferably have a common drive shaft, ensuring that they run at the same speed. The pressure fluid is preferably a liquid, most preferably hydraulic oil. The second orifice of the pilot valve is preferably continuously adjustable. The control valve is preferably continuously adjustable. A first fluid flow path preferably extends from the tank, via the second pump, onward via the first control point, onward via the first orifice and back to the tank. A second fluid flow path preferably extends from the load pressure connection point, via the second control point, onward via the second orifice to the tank. The displacement volume of the second pump is preferably considerably less than the maximum displacement volume of the first pump. The flow resistance of the first orifice is preferably continuously adjustable.

Advantageous developments and improvements of the disclosure are indicated in the claims, detailed description, and drawings.

Provision can be made for the pilot valve to be acted upon by a first spring in the opening direction of the second orifice. The first spring is preferably preloaded. The pressure equivalent of the first spring determines the speed of the first or second pump at which power limitation starts.

Provision can be made for a third orifice to be inserted between the load pressure connection point and the second control point. The flow resistance of the third orifice determines how sharply the pressure at the first work connection point is lowered when the first or second pump are no longer running at the desired speed. The third orifice is preferably a component part of the second fluid flow path.

Provision can be made for the control valve to be acted upon by the pressure at the work connection point in the sense of an adjustment, wherein it is acted upon by the pressure at the second control point in the sense of an adjustment in the opposite direction. Thus, the pressure at the first work connection point is controlled in accordance with the pressure at the second control point.

Provision can be made for the control valve to be acted upon by a second spring, which brings about an adjustment in the same direction as the pressure at the second control point. By means of the second spring, it is possible to set the pressure difference by which the pressure at the work connection point is higher than the pressure at the second control point.

Provision can be made for the control valve to have a first and a second control position, wherein pressure fluid can be passed from a third control point to the tank in the first control position, wherein pressure fluid can be passed from the work connection point to the third control point in the second control position, wherein the displacement volume of the first pump can be adjusted by means of the pressure at the third control point. This allows hydraulic adjustment of the displacement volume of the first pump and, in particular, the required pressure is provided at the third control point.

Provision can be made for the first pump to be assigned an adjusting cylinder, by means of which the displacement volume of the first pump can be adjusted, wherein the adjusting cylinder is acted upon by the pressure at the third control point in the sense of a reduction in the displacement volume. This ensures that a drop in the speed of the first or second pump results in a reduction in the pressure at the work connection point, ensuring that there is an upper limit on the required driving power. The adjusting cylinder is preferably a single-acting cylinder, to which most preferably a return spring is assigned.

Provision can be made for the pressure at the second control point to act on the control valve in the direction of an adjustment towards the first control position. This ensures that a drop in the speed of the first or second pump results in a reduction in the pressure at the work connection point, ensuring that there is an upper limit on the required driving power.

It is self-evident that the features mentioned above and those that remain to be explained below can be used not only in the respectively indicated combination but also in other combinations or in isolation without exceeding the scope of the present disclosure.

BRIEF DESCRIPTION OF THE DRAWINGS

The disclosure is explained in greater detail below with reference to the attached drawings, in which.

DETAILED DESCRIPTION

Figure 1:
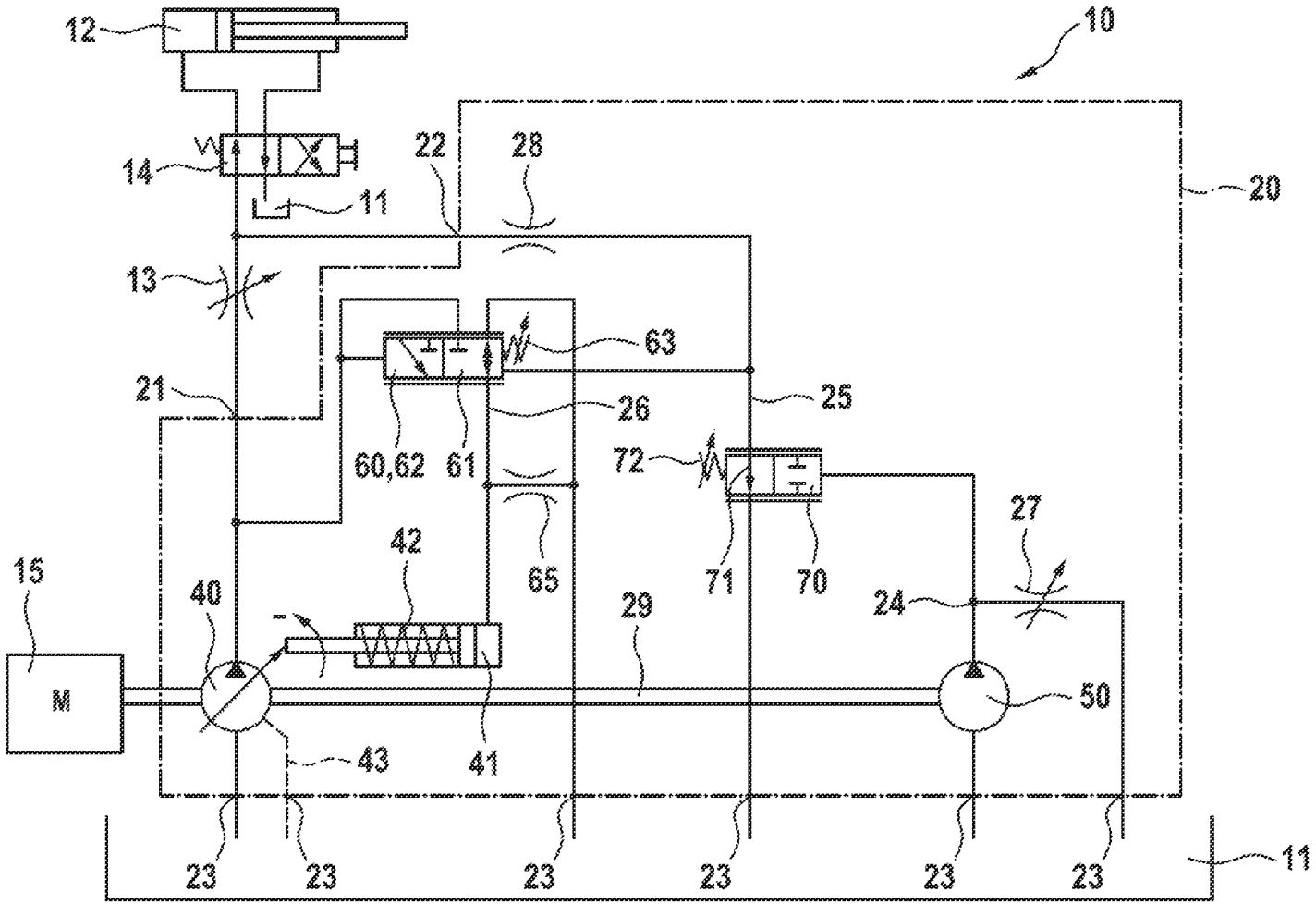
FIG. 1 shows a circuit diagram of a hydraulic drive system having a pump-regulator combination according to the disclosure.

FIG. 1 shows a circuit diagram of a hydraulic drive system 10 having a pump-regulator combination 20 according to the disclosure. The pump-regulator combination 20 has a first pump 40, which has an adjustable displacement volume. The first pump 40 is preferably designed as an axial piston pump, which is embodied as a swashplate-type design, for example. The first pump 40 draws pressure fluid out of a tank 11 and pumps it to a work connection point 21 of the pump-regulator combination 20. In the present case, it flows from there to a single, continuously adjustable, fourth orifice 13, onward to an associated directional control valve 14 and onward to an associated actuator 12. The actuator 12 is a hydraulic cylinder or a hydraulic motor, for example. The fourth orifice 13 is used to set the speed of motion of the actuator 12, wherein the direction of motion thereof is set by means of the directional control valve 14. The fourth orifice 13 and the directional control valve 14 are preferably formed by a common valve spool, allowing them to be adjusted jointly. The pressure fluid flowing back from the actuator 12 flows via the directional control valve 14 into the tank 11.

A plurality of actuators 12 can be provided, to each of which a fourth orifice 13 and a directional control valve 14 is assigned. A load pressure of the relevant actuator 12 is tapped off between the fourth orifice 13 and the directional control valve 14 in each case and is connected to the load pressure connection point 22 of the pump-regulator combination 20. If there is a plurality of actuators 12 present, the maximum load pressure of all the actuators is determined, and this is connected to the load pressure connection point 22. This can be accomplished by means of a shuttle valve cascade, for example.

The pump-regulator combination 20 furthermore has a second pump 50, which has a constant displacement volume, this preferably being considerably less than the maximum displacement volume of the first pump 40. The second pump 50 is preferably designed as a gear pump, in particular as an external gear pump. Assigned to the second pump 50 is a first fluid flow path, which extends from the tank 11, via the second pump 50, onward via a first control point 24, onward via a first orifice 27 and back to the tank 11. Thus, pressure fluid can be pumped along the first fluid flow path by the second pump 50. The flow resistance of the first orifice 27 is preferably continuously adjustable. The first and the second pump 40; 50 are driven jointly by a motor 15, which is preferably designed as an internal combustion engine and most preferably as a diesel engine. The first and the second pump 40; 50 preferably have a common drive shaft, ensuring that they run at the same speed. The second pump 50 thus brings about a constant delivery flow, which is proportional to the driving speed of the first pump 40. This delivery flow flows via the first orifice 27 and causes a pressure drop there. The pressure at the first control point 24 is thus a measure of the driving speed of the first pump 40. The first pump 40 is preferably provided with a leakage line 43, via which internal leaks in the first pump 40 are drained into the tank 11.

The pump-regulator combination 20 furthermore has a control valve 60, to which a third control point 26 is assigned. In a first control position 61 of the control valve 60, the third control point 26 is connected to the tank 11. For this purpose, the pump-regulator unit 20 has one or more tank connection points 23. In FIG. 1, for the sake of clarity, more tank connection points 23 are provided than are actually present. Accordingly, a plurality of flow paths connected to the tank 11 is preferably connected in parallel to a common tank connection point 23. In the second control position 62 of the control valve, the third control point 26 is connected to the work connection point 21. The control valve 60 is preferably continuously adjustable between the first and the second control position 61; 62, wherein there is most preferably no fluid connection leading via the control valve 60 between the work connection point 21 and the tank 11 in any control position.

The pressure at the work connection point 21 acts on the control valve 60 in the direction of an adjustment towards the second control position 62. The control valve 60 is acted upon in the opposite direction, i.e. towards the first control position 61, by the pressure at a second control point 25 and by a preloaded second spring 63. The preload of the second spring 63 is preferably continuously adjustable to set the amount by which the pressure at the work connection point 21 is above the pressure at the load pressure connection point 22.

The first pump 40 is provided with an adjusting cylinder 41. The adjusting cylinder 41 is preferably designed as a single-acting cylinder. Subjecting the adjusting cylinder 41 to pressure brings about a reduction in the displacement volume of the first pump 50. In contrast, the return spring 42 of the adjusting cylinder 41 brings about an increase in the displacement volume of the first pump 40. The adjusting cylinder 41 is acted upon by the pressure at the third control point 26. When the pressure at the work connection point 21 is greater than the sum of the pressure equivalent of the second spring 63 and the pressure at the second control point 25, the displacement volume of the first pump 40 decreases, with the result that the pressure at the work connection point 21 falls. When the pressure at the work connection point 21 is less than the sum of the pressure equivalent of the second spring 63 and the pressure at the second control point 25, the displacement volume of the first pump 40 increases, with the result that the pressure at the work connection point 21 rises. Consequently, the pressure at the work connection point 21 is adjusted to the sum of the pressure equivalent of the second spring 63 and the pressure at the second control point 25.

Attention should be drawn to the fifth orifice 65, via which the third control point 26 is connected to the tank 11. Via the fifth orifice 65, internal leaks are drained off towards the tank 11, ensuring that they cannot bring about any unwanted adjustment of the first pump 40. The flow resistance of the fifth orifice 65 is preferably designed to be so small that the desired pressure buildup described above at the third control point 26 is essentially not disrupted.

The pump-regulator combination 20 furthermore has a second fluid flow path, which extends from the load pressure connection point 22, via a third orifice 28, onward via the second control point 25 and onward via a second orifice 71 of a pilot valve 70 to the tank 11. The second orifice 71 is adjustable, preferably continuously adjustable. As long as it is completely closed, the pressure at the second control point 25 is equal to the pressure at the load pressure connection point 25. This state is present whenever the motor is running at the desired speed. For this, the pressure at the first control point 24 acts on the pilot valve 70 in the opening direction of the second orifice 71. In the opposite direction, the pilot valve is acted upon by a preloaded first spring 72.

The desired speed of the first and the second pump is 1700-1800 rpm, for example. The second pump 50 has a displacement volume of 1 $cm^3$, for example, giving a delivery flow of 1.7-1.8 l/min. The first orifice 27 has an orifice diameter of 0.8 mm, for example, giving a pressure of between 10 and 20 bar at the first control point 24. The pressure equivalent of the first spring 72 is 10 bar, for example, ensuring that the second orifice 71 is completely closed under the existing boundary conditions. If the power of the motor 15 is no longer sufficient to deliver the desired fluid flow at the desired pressure, the speed of the motor 15 falls. Consequently, the delivery flow of the second pump 50 and hence the pressure at the first control point 24 falls. As a result, the second orifice 71 opens, opening the second fluid flow path from the load pressure connection point 22 to the tank 11. As a consequence, there is a pressure drop across the third orifice 28, with the result that the pressure at the second control point 25 falls below the pressure at the load pressure connection point 22. This, in turn, has the effect that the pressure at the work connection point 21 falls, as a result of which the load on the motor 15 decreases, and therefore the speed thereof rises to the desired speed again. Ultimately, the maximum driving power to be produced by the motor 15 is limited in a simple manner by the pump-regulator combination 20 under consideration.

Figure 2:
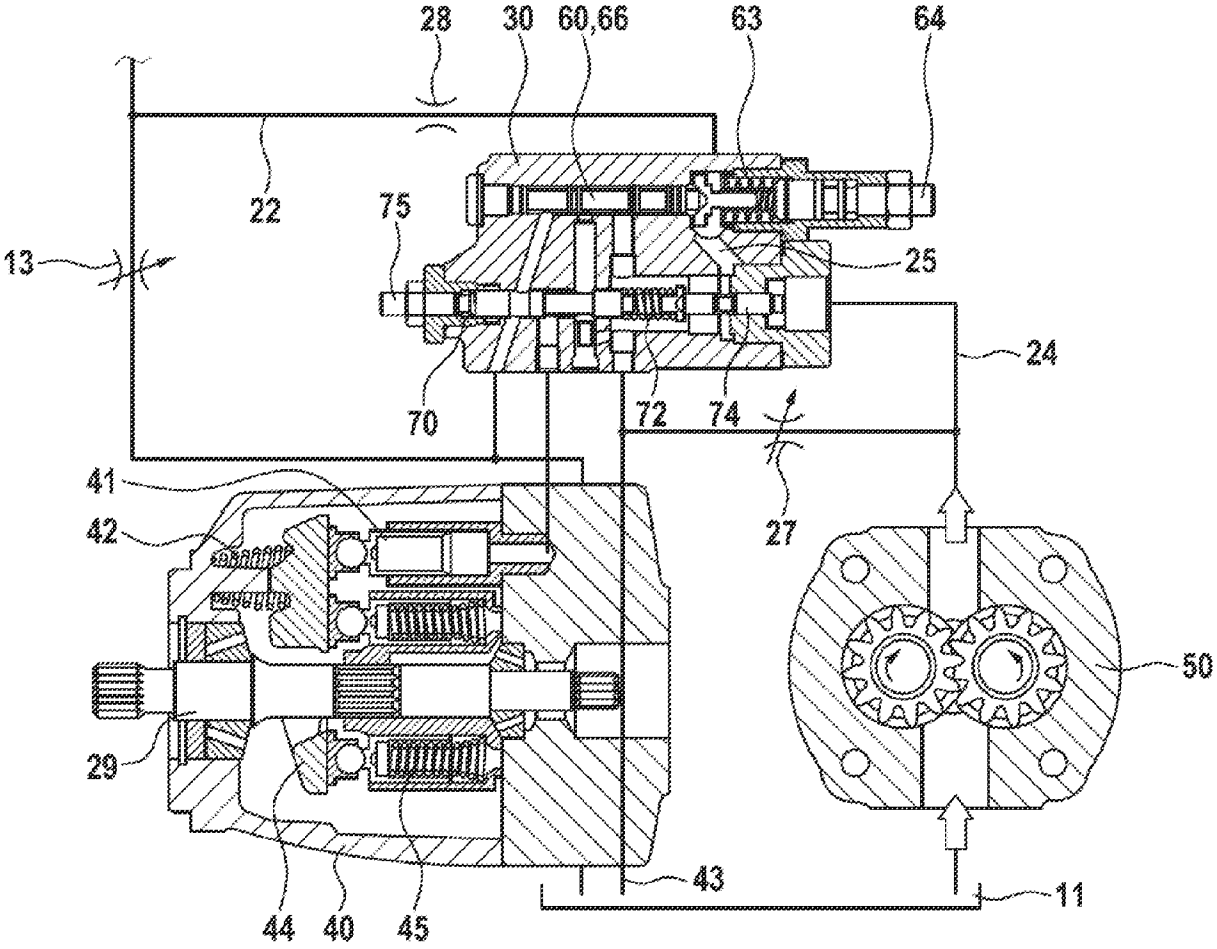
FIG. 2 shows a rough schematic representation of the pump-regulator combination according to FIG. 1.

FIG. 2 shows a rough schematic representation of the pump-regulator combination 20 according to FIG. 1. From the sectional representation of the first pump 40, it can be seen that, in the present case, this pump is designed as an axial piston pump of swashplate-type construction. The adjusting cylinder 41 is arranged within the first pump 40, wherein it presses against the swashplate 44. The return spring 42 is arranged on the opposite side of the swashplate 44.

The first pump 40 is provided with a leakage line 43, which is connected to the tank 11. The pressure fluid flowing to the tank from the first orifice 27 is preferably passed via this leakage line 43 in order to enable the control valve 60 and the pilot valve 70 to be mounted directly on the first pump 40.

The first pump 50 is in the form of an external gear pump, which is shown in a rough schematic sectional view.

The control valve 60 and the pilot valve 70 are arranged in a common subassembly 30, wherein the control spools 66, 74 concerned are arranged in parallel. The common subassembly 30 is preferably arranged on the first pump 40. The pressure at the first control point 24 pushes the control spool 74 of the pilot valve to the left in FIG. 2. The first spring 72 acts in the opposite direction. By means of the adjusting screw 75, the preload of the first spring 72 can be adjusted. Overall, the pressure at the second control point 25 does not exhibit any force on the control spool 74 of the pilot valve 70.

Attention should furthermore be drawn to adjusting screw 64, by means of which the preload of the second spring 63 on the control valve 60 can be adjusted.

The at least one actuator with the respectively associated directional control valve is not shown in FIG. 2.

REFERENCE SIGNS

10 hydraulic drive system
11 tank
12 actuator
13 fourth orifice
14 directional control valve
15 motor
20 pump-regulator unit
21 work connection point
22 load pressure connection point
23 tank connection point
24 first control point
25 second control point
26 third control point
27 first orifice
28 third orifice
29 drive shaft
30 common subassembly
40 first pump
41 adjusting cylinder
42 return spring
43 leakage line
44 swashplate
45 piston
50 second pump
60 control valve
61 first control position of the control valve
62 second control position of the control valve
63 second spring
64 adjusting screw of the control valve
65 fifth orifice
66 control spool of the control valve
70 pilot valve
71 second orifice
72 first spring
74 control spool of the pilot valve
75 adjusting screw of the pilot valve

What is claimed is:

1. A pump-regulator combination for use with a tank and at least one actuator, comprising a first pump that has an adjustable displacement volume, and that is configured to pump pressure fluid from a tank to a work connection point;

a control valve configured to control at least one of a pressure and a delivery flow at the work connection point by adjusting the adjustable displacement volume of the first pump;

a second pump that has a constant displacement volume, that is configured to be jointly driven with the first pump, and that is further configured to pump the pressure fluid from the tank to a first control point;

a first orifice that is connected to the first control point and that is configured to connect to the tank to enable the pressure fluid from the second pump to return to the tank; and a pilot valve including an adjustable second orifice, the second orifice connected to a load pressure connection point via a second control point, the load pressure connection point configured to connect to a highest load pressure of at least one actuator, and the second orifice further configured to connect to the tank to enable the pressure fluid to pass from the load pressure connection point to the tank;

wherein:

a pressure at the first control point acts on the pilot valve in a closing direction of the second orifice; and a pressure at the second control point acts on the control valve as an adjustment.

2. The pump-regulator combination of claim 1, further comprising:

a first spring that acts on the pilot valve in an opening direction of the second orifice.

3. The pump-regulator combination of claim 1, further comprising:

a third orifice in fluid communication between the load pressure connection point and the second control point.

4. The pump-regulator combination of claim 1, wherein:

the pressure at the work connection point acts on the control valve as an adjustment in a direction opposite to a direction of action of the adjustment by the pressure at the second control point.

5. The pump-regulator combination of claim 1, further comprising:

a second spring that acts on the control valve in a same direction as the pressure at the second control point.

6. The pump-regulator combination of claim 1, wherein the control valve includes a first control position and a second control position, and is further configured to:

in the first control position, enable the pressure fluid to pass from a third control point to the tank; and in the second control position, enable the pressure fluid to pass from the work connection point to the third control point, such that adjustment of the adjustable displacement volume of the first pump is based upon a pressure at the third control point.

7. The pump-regulator combination of claim 6, further comprising:

an adjusting cylinder operably connected to the control valve, the adjusting cylinder operable to adjust the adjustable displacement volume of the first pump based upon the pressure at the third control point.

8. The pump-regulator combination of claim 7, wherein the adjustment by the pressure at the second control point acts on the control valve in a direction of adjustment toward the first control position.

9. A hydraulic drive system, comprising:

a tank;

at least one actuator; and a pump-regulator combination that includes:

a first pump that has an adjustable displacement volume, and that is configured to pump pressure fluid from the tank to a work connection point;

a control valve configured to control at least one of a pressure and a delivery flow at the work connection point by adjusting the adjustable displacement volume of the first pump;

a second pump that has a constant displacement volume, that is configured to be jointly driven with the first pump, and that is further configured to pump the pressure fluid from the tank to a first control point;

a first orifice that is connected to the first control point and to the tank to enable the pressure fluid from the second pump to return to the tank; and a pilot valve including an adjustable second orifice, the second orifice connected to a load pressure connection point via a second control point, the load pressure connection point connected to a highest load pressure of the at least one actuator, and the second orifice further connected to the tank to enable the pressure fluid to pass from the load pressure connection point to the tank;

wherein:

a pressure at the first control point acts on the pilot valve in a closing direction of the second orifice; and a pressure at the second control point acts on the control valve as an adjustment.

* * * * *